United States Patent [19]

Yamashita et al.

[11] Patent Number: 4,731,286

[45] Date of Patent: Mar. 15, 1988

[54] RADIO-WAVE ABSORPTIVE GASKET

[75] Inventors: Hiroshi Yamashita, Ichikawa; Yoshiaki Okada, Koshigaya; Hiroshi Suzuki, Ichikawa, all of Japan

[73] Assignee: TDK Corporation, Tokyo, Japan

[21] Appl. No.: 713,518

[22] Filed: Mar. 19, 1985

[30] Foreign Application Priority Data

Sep. 18, 1984 [JP] Japan ..... 59-193943

[51] Int. Cl.[4] ..... H01P 1/26

[52] U.S. Cl. ..... 428/329; 252/62.54; 428/694; 428/900

[58] Field of Search ..... 252/62.54; 428/694, 428/900, 329

[56] References Cited

U.S. PATENT DOCUMENTS

| | | | |
|---|---|---|---|
| 3,184,807 | 5/1965 | Schornstheimer et al. | 252/62.54 X |
| 3,581,245 | 5/1971 | Ohi et al. | 252/62.54 X |
| 3,584,176 | 6/1971 | Cannon et al. | 252/62.54 X |
| 4,126,567 | 11/1978 | Otera et al. | 252/62.54 X |
| 4,137,361 | 1/1979 | Deffeyes et al. | 428/694 X |

OTHER PUBLICATIONS

Merck Index, ninth ed., 1976, pp. 525–526.

*Primary Examiner*—Nancy A. B. Swisher

*Attorney, Agent, or Firm*—Seidel, Gonda, Goldhammer & Abbott

[57] ABSTRACT

A radio-wave absorptive gasket capable particularly of absorbing micro-wave over 10 GHz is provided. The gasket comprises a mixture of Mn-Zn ferrite powder consisting of 4 to 22 mol% MnO, 10 to 18 mol% ZnO and 66 to 78 mole% $Fe_2O_3$ with rubber of plastic material.

4 Claims, 5 Drawing Figures

RADIO-WAVE ABSORPTIVE GASKET

DESCRIPTION OF THE INVENTION

1. Field of the Invention

This invention relates to a radio-wave absorptive gasket for microwave ovens, and more specifically to such a gasket highly capable of absorbing microwave energies at frequencies above 10 GHz.

2. Prior Art

Microwave ovens utilizing the microwave radio energy are in wide use. Ovens of this type usually employ a magnetron that produces microwaves at 245 GHz, a radio-wave energy harmful to the human being. For the protection purpose it is customary to cover the oven with metal plates and wire gauze and dispose choke or radio-wave absorptive member in the gap between the opposing faces of the oven body and the door through which radio waves could otherwise leak.

As the radio-wave absorptive member, gaskets made of a composite ferrite prepared by mixing high-permeability ferrite powder with rubber or plastics are extensively used.

These gaskets are designed principally to absorb radio waves at frequencies of 245 GHz or thereabouts. For their higher harmonics, especially the components of 10 GHz and upward, the necessity of absorption or attenuation has not been studied. Neither has any gasket capable of controlling those components been developed yet. However, the leakage of such high-frequency waves from microwave ovens is undesirable because of the disorder or adverse effect it can have upon broadcasting and communication activities, for example in Europe and other continents where the operations use frequencies of more than 10 GHz, e.g., 12 GHz.

The rubber- or plastics-ferrite gaskets currently in used include a group using powdered ferrites of the Mn-Zn system. The ferrites typically consist of 28 to 24 mol % MnO, 12 to 16 mol % ZnO, and 52 to 56 mol % $Fe_2O_3$. A gasket employing such a ferrite exhibits a transmission loss of more than 20 dB/cm in the frequency range of 2 to 12 GHz as illustrated in FIG. 1. This characteristic, however, does not mean that the gasket has excellent attenuation or absorption characteristic at 10 GHz or upward but means only that it is effective for the region from about 2.45 GHz to the fourth higher harmonic (9.8 GHz). This is explained by the fact that the gasket, which proves effectively when combined with the metal plates and choke, can no longer work fully effectively at over 10 GHz.

Thus, the present inventors, recognizing that there is a limitation to the structural improvement of microwave ovens and that the characteristics of the gasket itself must be improved before the problem can be solved, have made intensive studies on the subject and have not perfected this invention.

Object of the Invention

This invention aims at providing a rubber- or plastics-ferrite gasket capable of satisfactorily attentuating radio waves at frequencies of 10 GHz and upward.

Summary of the Invention

The invention resides in a radio-wave absorptive gasket for microwave ovens made of a mixture of ferrite magnetic powder and rubber or plastics, characterized in that the ferrite consists of 4 to 22 mol % MnO, 10 to 18 mol % ZnO, and 66 to 78 mol % $Fe_2O_3$.

The ferrite powder has a saturation magnetic flux density ($4\pi Is$) of a grain compact as mixed with a group member of at least 3800 G or at least 2900 G.

The gasket according to the invention is highly absorptive for radio waves at frequencies of 10 GHz or more and therefore can adequately attenuate the radio waves that leak out through any gap of the microwave oven or the like.

DETAILED DESCRIPTION OF THE INVENTION

Figure 1:
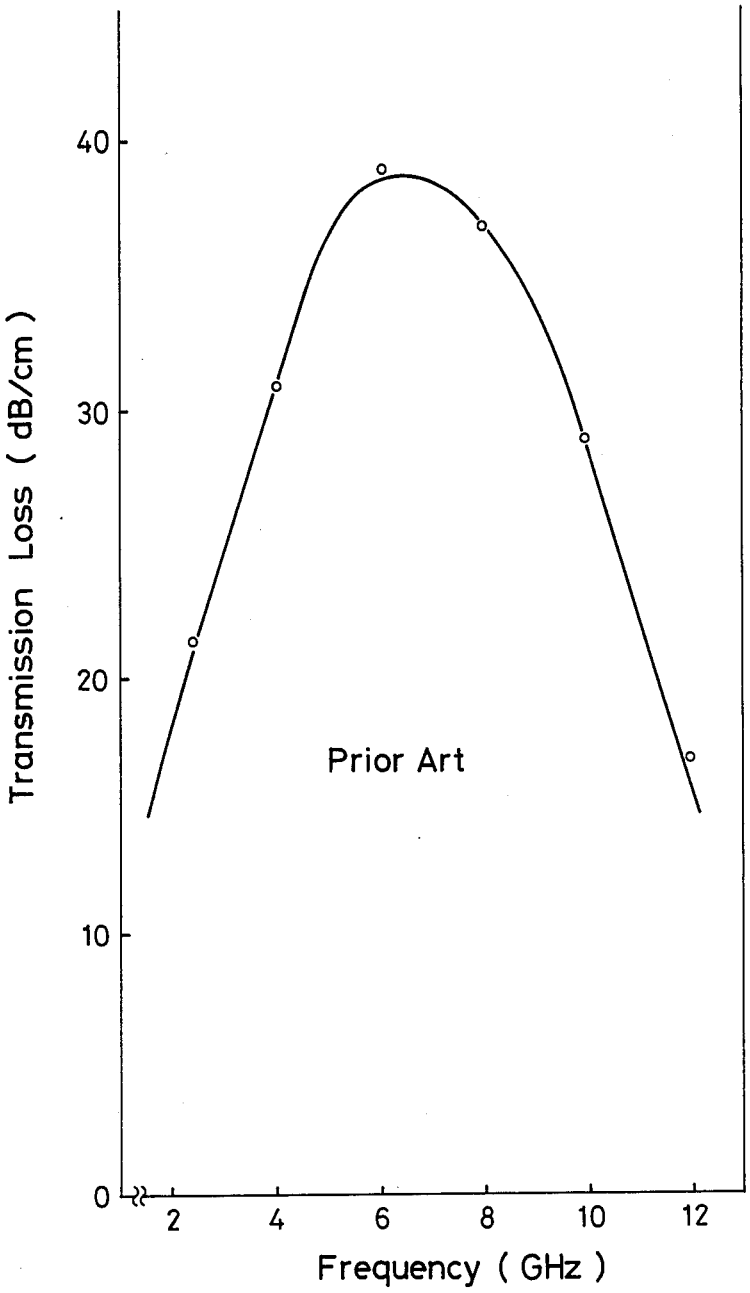
FIG. 1 is a graph showing the radio-wave absorption characteristic of a conventional rubber- or plastics-ferrite gasket.

The present inventors modified the ferrite composition in the gasket of the characteristics shown in FIG. 1 to varying degrees and observed the consequent characteristic changes. The experiments revealed that the improvement in absorption characteristic with an increase in saturation magnetic flux density ($4\pi Is$) is inconsistent; the characteristic sometimes improves but in other cases not. The improvements at 10 GHz and higher frequencies are rather negligible. In view of these, the present inventors gave up the effort for improving the Mn-Zn ferrite in and around the above-mentioned composition range that had been believed best for gasket material. They took another look at the Mn-Zn ferrite, from the very foundation of the system, and the renewed research has led to the present invention.

With the conventional Mn-Zn ferrite the inventors tried to increase the ferrous proportion substantially and decrease the manganese component also substantially. In this way they have found that a gasket exhibiting excellent radio-wave absorption characteristic at 10 GHz and upward can be provided. The radio-wave absorption and other characteristics of ferrite are largely dependent upon frequency, and from the test results at 2.45 GHz one skilled in the art cannot predict the characteristics at 10 GHz and higher frequencies. Whereas, in fact, the afore-mentioned composition of Mn-Zn ferrite has been deemed optimum for use at 2.45 GHz, the composition in the ranges specified under the invention must be employed at and above 10 GHz.

The composition of the Mn-Zn ferrite according to the invention, in terms of oxides, consists of 4 to 22 mol % MnO, 10 to 18 mol % ZnO, and 66 to 78 mol % $Fe_2O_3$. When ZnO is within this range the $4\pi Is$ is high enough to make the ferrite desirable as a radio-wave absorbent. However, a merely high $4\pi Is$ is not satisfactory as has already been considered. If the MnO proportion exceeds 22 mol %, the radio-wave absorption characteristic of the resulting ferrite at 10 GHz or above declines. Similarly, less than 66 mol % $Fe_2O_3$ reduces the radio-wave absorption in the same frequency range. The same is true of less than 4 mol % MnO or of more than 78% $Fe_2O_3$. Moreover, the larger the percentage of $Fe_2O_3$, the greater the technical difficulties involved in the fabrication will be if the magnetic properties are to be retained stably The rubber or plastics to be employed in the present invention may be any of those being used in the art. It may, for example, be chloroprene rubber or other synthetic rubber, or a thermoplastic or thermosetting plastics such as polypropylene or polyamide.

The present invention is illustrated by the following examples.

EXAMPLES

Ferrites of the Mn-Zn system with varied compositions were made. Each ferrite was ground to ferrite powder about 2 to 3 microns in average particle diameter. Chloroprene rubber was mixed with each ferrite powder at a rubber to ferrite weight ratio of 1:5. The mixture was kneaded by a two-roll mill for about 10 minutes to form a sheet about 3 mm thick, cut into test gasket pieces of a predetermined size, and the test pieces were press-cured. The cured pieces were tested for the measurement of their 4 Is and transmission loss values.

Figure 3:
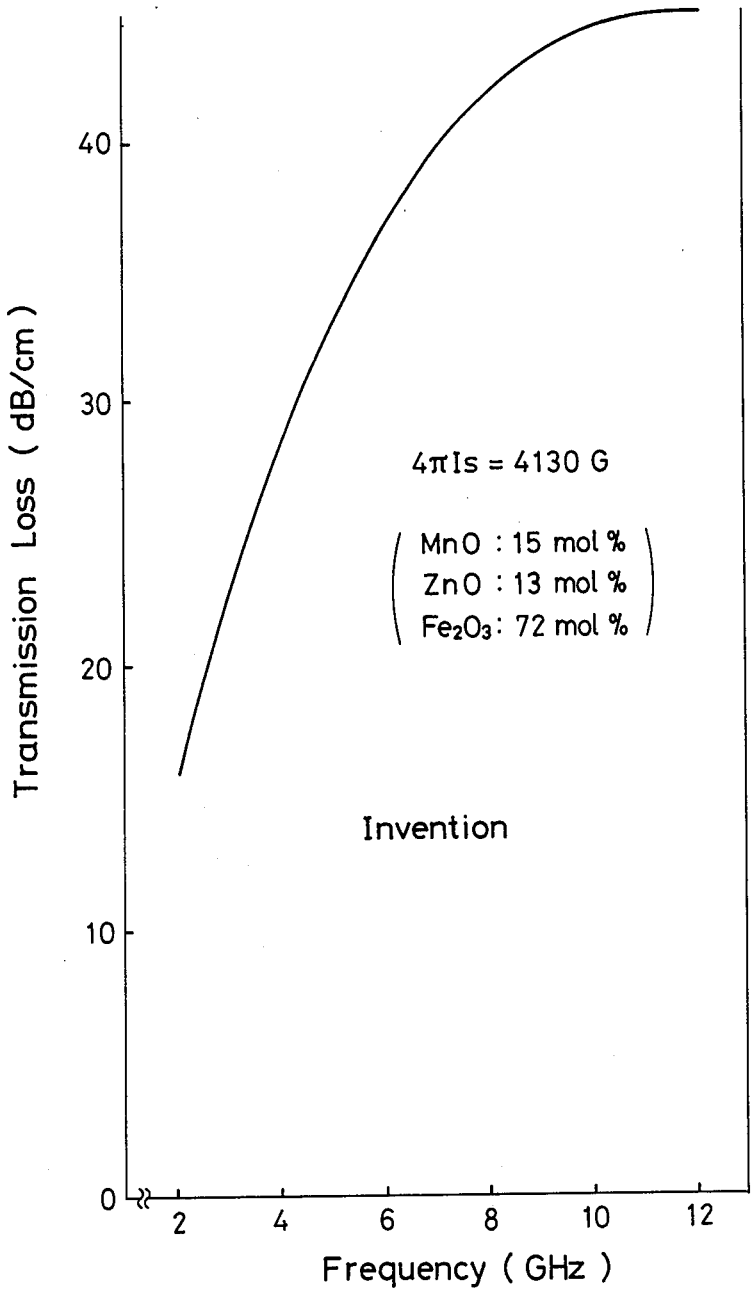
FIGS. 3, 4 and 5 are graphs showing the radio-wave absorption characteristic of a gasket of the invention.

FIG. 3 shows a triangular diagram in which transmission losses at 12 GHz are plotted, the coordinates given representing the molar percentages of the oxides. The region in which the losses at 12 GHz are 30 dB/cm or upward is indicated with a circle.

Method of Forming Green Compacts to be Tested

Twenty grams of each ferrite powder was placed in a given mold, and molded by a press at a pressure of 50 kg/cm$^2$ into a cylindrical green compact for testing, measuring 20 mm in diameter and 10 mm in length. The compact was tested for the measurment of its $4\pi$Is.

Measurement Of Transmission Loss

The transmission loss was measured at 2.45 GHz with a wave guide, WRJ-2, and at 8 to 12 GHz with a wave guide, WRJ-10. For measurements at intermediate frequencies wave guides of intermediate capacities were used. To simulate the wave leakage path in the gap between the microwave oven body and the door, a tapered or stepped jig was inserted into each wave guide to narrow the corresponding gap and avoid any change is impedance between the front and rear of the system. From the values measured with the test piece placed or not placed in the gap, the loss per centimeter of the gasket length was calculated.

Figure 2:
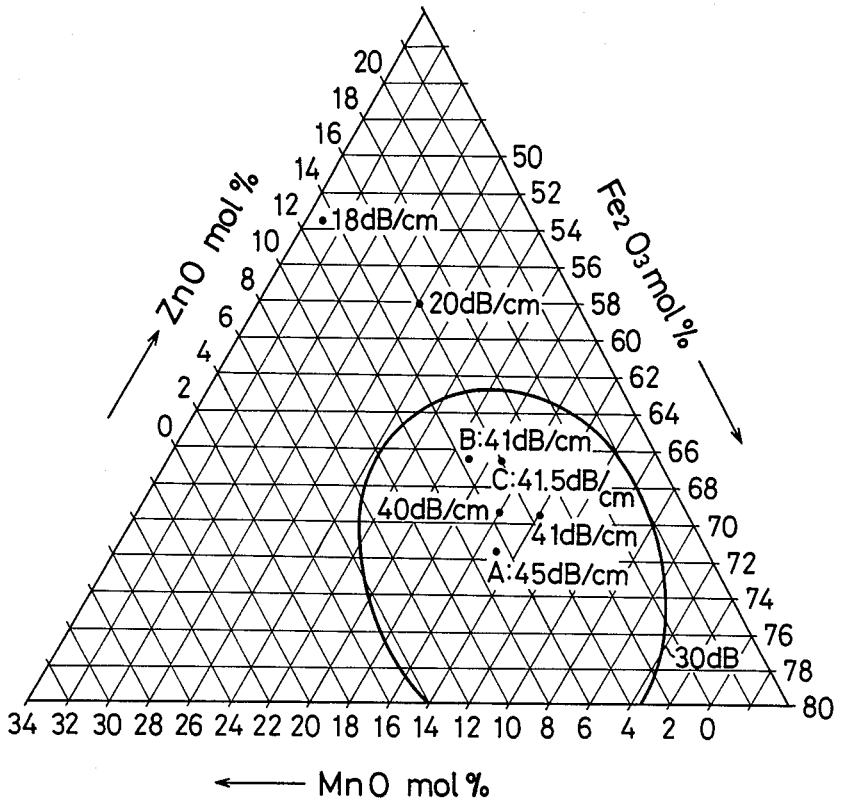
FIG. 2 is a triangular diagram of gaskets using Mn-Zn ferrites according to the invention.
Figure 4:
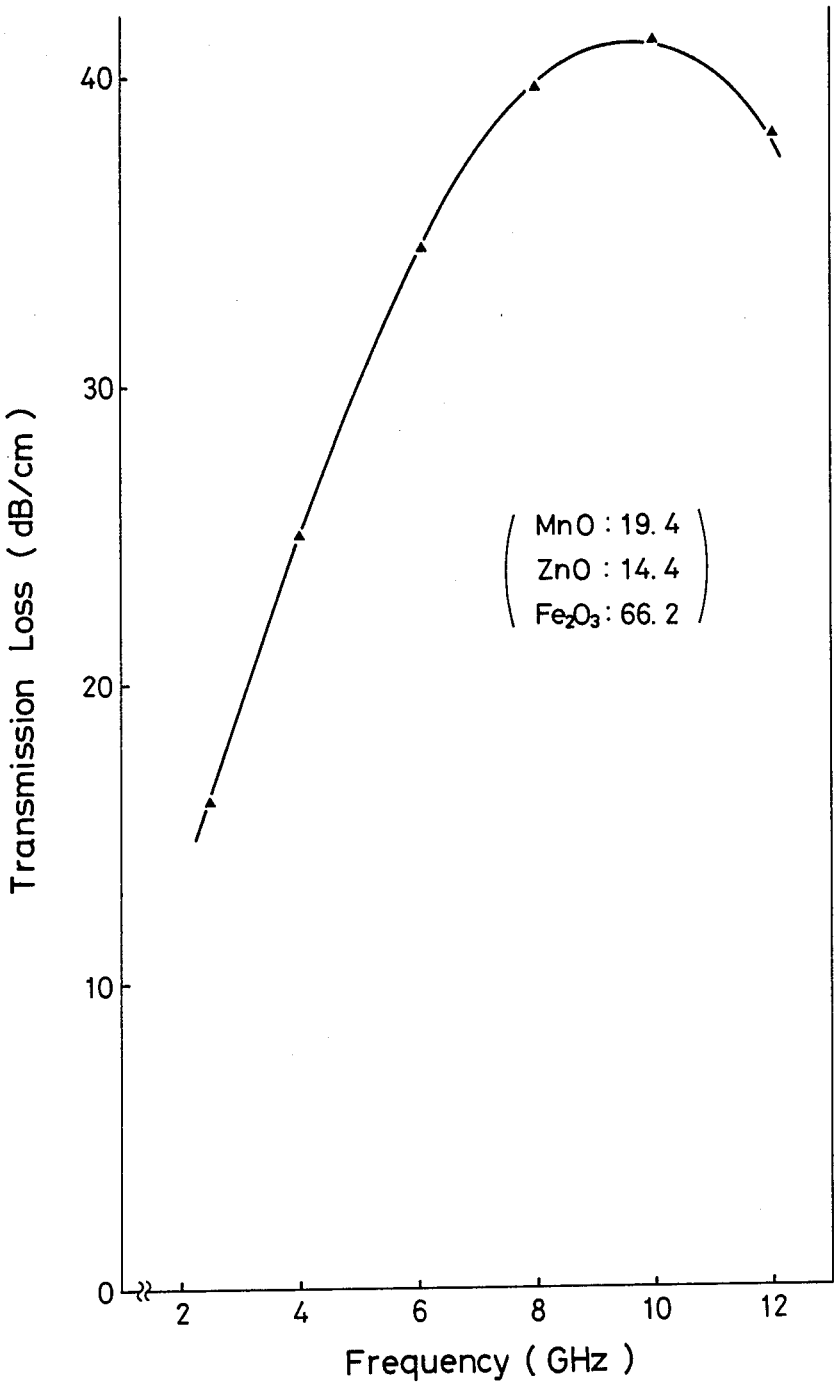
Figure 5:
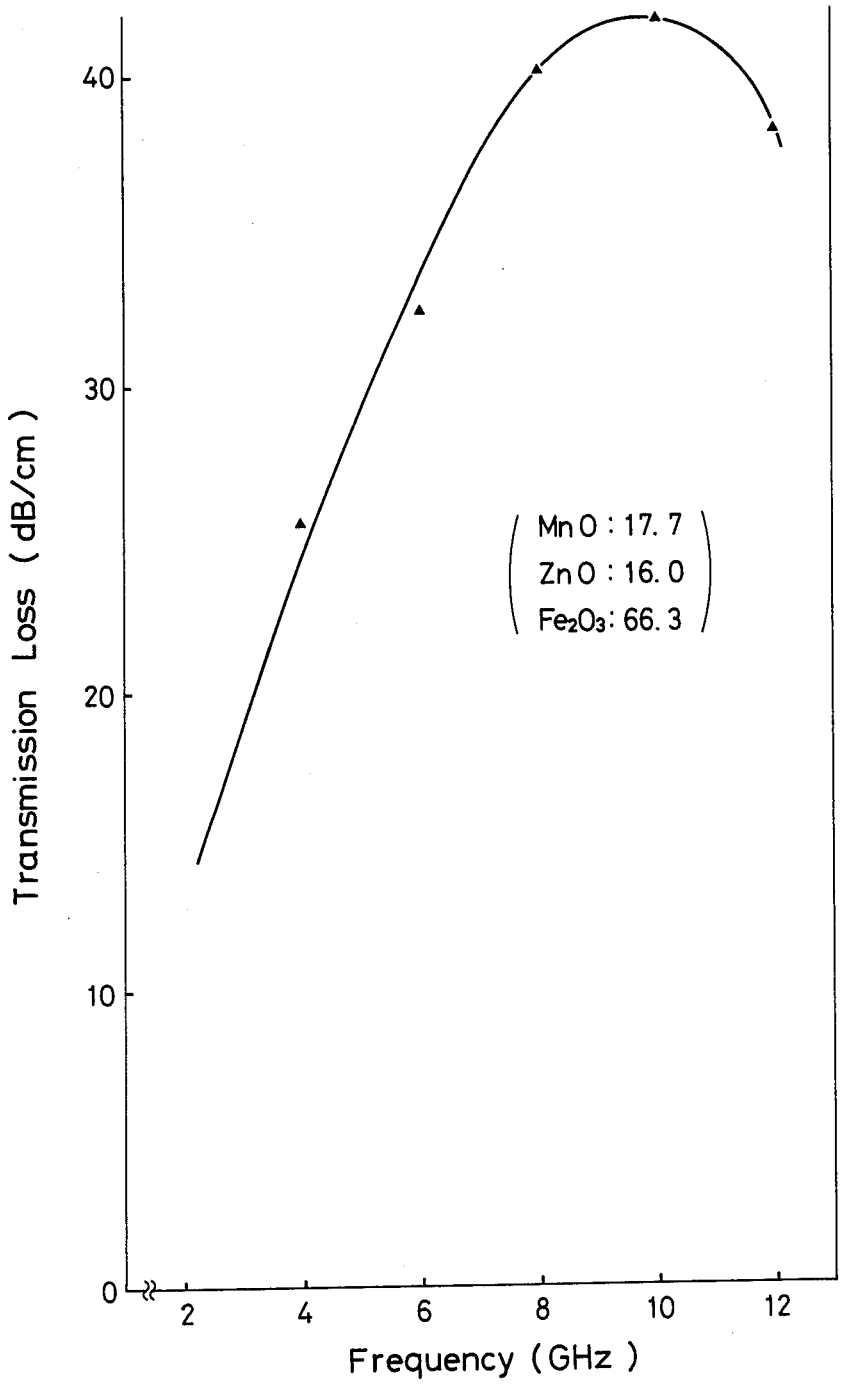

The results are given in FIGS. 3, 4 and 5 which correspond to the compositions A, B and C shown in FIG. 2, respectively.

Advantages

It is obvious from the results of FIGS. 3, 4 and 5 as compared with those of the prior art in FIG. 1, that the gasket according to this invention shows an absorption characteristic utterly different from those of conventional gaskets, exhibiting very large transmission losses particularly at 10 GHz and higher frequencies. As can be seen from FIG. 2, the loss at 12 GHz is substantial with the gasket of the compositional ranges of the invention, clearly demonstrating its superiority. Although the gasket of the invention is less absorptive of radio waves at 2.45 GHz than the existing ones, this deficiency can be adequately made up for by modifying the construction of the microwave oven as noted above. On the other hand, this invention solves more than satisfactorily the radio-wave leakage problem at 10 GHz and higher frequencies that has hitherto been left unsettled.

What is claimed is:

1. In a radio-wave absorptive gasket, the improvement comprising:

a mixture of a Mn-Zn magnetic ferrite powder consisting of 4–22 mol percent MnO, 10–18 mol percent ZnO, and 68–78 mol percent $Fe_2O_3$ and a member selected from the group consisting of a rubber, a plastic, and mixtures thereof.

2. The gasket according to claim 1 said ferrite powder has a saturation magnetic flux density ($4\pi$ls) of green compact pressed at a temperature of 1 ton/cm$^2$ of at least 3800G.

3. The gasket according to claim 1 wherein said ferrite powder has a saturation magnetic flux density ($4\pi$ls) of a green compact as mixed with a group member of at least 2900 G.

4. The gasket according to claim 1 wherein said ferrite powder has a transmission loss per unit length of a peak value in the range of about 10 to 14 Ghz.

* * * * *